US005622089A

United States Patent [19]

Gifford, Sr.

[11] Patent Number: 5,622,089

[45] Date of Patent: Apr. 22, 1997

[54] RATCHET WRENCH WITH THUMB ACTIVATED DIRECTION CONTROL SWITCH

[76] Inventor: Robert W. Gifford, Sr., 1411 Kittanning Pike, Karns City, Pa. 16041

[21] Appl. No.: 572,036

[22] Filed: Dec. 14, 1995

[51] Int. Cl.[6] ..... B25B 13/46

[52] U.S. Cl. ..... 81/62; 192/43.1

[58] Field of Search ..... 81/62, 63.9; 192/43, 192/43.1, 43.2

[56] References Cited

U.S. PATENT DOCUMENTS

| | | | |
|---|---|---|---|
| 4,277,989 | 7/1981 | Tracy | 81/62 |
| 4,300,413 | 11/1981 | Garofalo | 81/62 |
| 4,445,404 | 5/1984 | Parker | 81/62 |
| 4,566,356 | 1/1986 | Herota | 81/62 |
| 4,589,307 | 5/1986 | Parker | 81/62 |
| 5,000,066 | 3/1991 | Gentiluomo | 81/62 |

*Primary Examiner*—James G. Smith

[57] ABSTRACT

A ratchet wrench with thumb activated direction control switch comprising: a shaft including a head with an essentially hollow interior and a handle, a circular gear being rotatably mounted within the head, a socket engagement block being coupled to the circular gear through the head, a ratchet assembly including two bevel arms pivotally coupled within the head, a half pinion being formed in a semicircular configuration with gear teeth and an upstanding biasing member, the half pinion being pivotally coupled within the head with the biasing member positioned between the bevel arms; and the handle including a rectangular bore and an elongated aperture extending into the head and in communication with the rectangular bore, a switch being coupled within the bore, the switch having a bar extending into the head, the bar having a forward end including a rack with a plurality of teeth, the rack meshing with the gear teeth of the half pinion.

4 Claims, 3 Drawing Sheets

RATCHET WRENCH WITH THUMB ACTIVATED DIRECTION CONTROL SWITCH

BACKGROUND OF THE INVENTION

1. Field of the Invention

The present invention relates to a ratchet wrench with thumb activated direction control switch and more particularly pertains to enabling users to easily reverse the operational direction of the ratchet assembly by manipulating the thumb activated switch of the apparatus.

2. Description of the Prior Art

The use of ratchet devices is known in the prior art. More specifically, ratchet devices heretofore devised and utilized for the purpose of tightening and loosening bolts by using the devices in the suggested manner are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No 4,086,829 to Hudgins a speed handle ratchet.

U.S. Pat. No. 5,178,047 to Arnold discloses a reversible ratchet wrench.

U.S. Pat. No. 5,142,953 to Lin discloses a ratchet screw driver.

U.S. Pat. No. 5,058,463 to Wannop discloses a ratchet wrench with dual-rotating constant drive handle.

U.S. Pat. No. 4,262,561 to Mize discloses a ratchet and gear drive socket wrench handle.

U.S. Pat. No. 3,598,001 to Thomasian discloses a reversible ratchet handle for socket wrench.

In this respect, the ratchet wrench with thumb activated direction control switch according to the present invention substantially departs from the conventional concepts and designs of the prior art, and in doing so provides an apparatus primarily developed for the purpose of enabling users to easily reverse the operational direction of the ratchet assembly by manipulating the thumb activated switch of the apparatus.

Therefore, it can be appreciated that there exists a continuing need for a new and improved ratchet wrench with thumb activated direction control switch which can be used for enabling users to easily reverse the operational direction of the ratchet assembly by manipulating the thumb activated switch of the apparatus. In this regard, the present invention substantially fulfills this need.

SUMMARY OF THE INVENTION

In view of the foregoing disadvantages inherent in the known types of ratchet devices now present in the prior art, the present invention provides an improved ratchet wrench with thumb activated direction control switch. As such, the general purpose of the present invention, which will be described subsequently in greater detail, is to provide a new and improved ratchet wrench with thumb activated direction control switch and method which has all the advantages of the prior art and none of the disadvantages.

To attain this, the present invention essentially comprises a new and improved ratchet wrench with thumb activated direction control switch comprising, in combination: a shaft formed in an elongated configuration with a generally circular shaped head, a generally oval shaped handle and a generally rectangular central region therebetween; the head having an upper surface, a lower surface and a central wall therebetween, the head having an essentially hollow interior with an upper portion, a lower portion, an inboard section and an outboard section, the upper portion of the outboard section including a large circular gear rotatably mounted therein, the circular gear having a periphery including a plurality of gear teeth, a socket engagement block being coupled to the circular gear through the central wall and lower surface of the head, the block being formed in a generally rectangular configuration with a spring biased ball extending therein; a ratchet assembly including first and second bevel arms and a half pinion, each bevel arm having an inner end pivotally coupled to the upper portion of the inboard section of the head, the bevel arms being angled outwardly with respect to each other, each bevel arm having an outer surface including a biasing spring coupled to the inboard section of the head, the biasing springs urging the arms toward each other, an aperture extending through the central wall between the bevel arms, the half pinion being formed in a generally semicircular configuration with a rounded perimeter including a plurality of gear teeth, the half pinion having a linear edge including a rounded projection and an upper surface including an upstanding biasing member, the biasing member being formed in a generally triangular configuration with rounded edges, the biasing member being positionable through the aperture in the central wall and pivotable therein, the rounded projection being pivotally coupled to the central wall in the lower portion of the head thereby allowing pivotal movement of the half pinion in the lower portion; the upper surface of the handle including a rectangular bore extending therethrough, the bore having two sidewalls each including an elongated semicylindrical recess, the handle and central section including an elongated aperture extending therethrough, the elongated aperture being in communication with the rectangular bore, the aperture of the central section including two spaced semispherical indents; and a switch formed in a generally rectangular configuration with a raised upper surface, the switch having a shorter length than the bore, the switch having two sidewalls each including elongated semicylindrical projections adapted to be slidably coupled within the recesses of the bore, the upper surface of the switch extending outside the bore, the switch having a lower surface including a planar rectangular shaped bar extending therefrom, the bar having a forward end including a rack with a plurality of teeth, the bar being positioned through the elongated aperture in the handle and central sections, the rack of the bar being positioned within the lower portion of the inboard section of the head with the teeth of the rack meshing with the gear teeth of the half pinion, the bar including a spring biased ball extending therefrom and adapted to be slidably positioned in a semispherical indent within the aperture, a user sliding the switch into a forward position to pivot the upstanding member of the half pinion against the first bevel arm thereby permitting tightening of a bolt in a clockwise direction, a user sliding the switch into a rearward position to pivot the upstanding member of the half pinion against the second bevel arm thereby permitting loosening of a bolt in a counter clockwise direction.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved ratchet wrench with thumb activated direction control switch which has all of the advantages of the prior art ratchet devices and none of the disadvantages.

It is another object of the present invention to provide a new and improved ratchet wrench with thumb activated direction control switch which may be easily and efficiently manufactured and marketed.

It is further object of the present invention to provide a new and improved ratchet wrench with thumb activated direction control switch which is of durable and reliable constructions.

An even further object of the present invention is to provide a new and improved ratchet wrench with thumb activated direction control switch which is susceptible of a low cost of manufacture with regard to both materials and labor, and which accordingly is then susceptible of low prices of sale to the consuming public, thereby making such ratchet wrench with thumb activated direction control switch economically available to the buying public.

Still yet another object of the present invention is to provide a new and improved ratchet wrench with thumb activated direction control switch which provides in the apparatuses and methods of the prior art some of the advantages thereof, while simultaneously overcoming some of the disadvantages normally associated therewith.

Still another object of the present invention is enabling users to easily reverse the operational direction of the ratchet assembly by manipulating the thumb activated switch of the apparatus.

Lastly, it is an object of the present invention to provide a new and improved ratchet wrench with thumb activated direction control switch comprising: a shaft including a head with an essentially hollow interior and a handle, a circular gear being rotatably mounted within the head, a socket engagement block being coupled to the circular gear through the head, a ratchet assembly including two bevel arms pivotally coupled within the head, a half pinion being formed in a semicircular configuration with gear teeth and an upstanding biasing member, the half pinion being pivotally coupled within the head with the biasing member positioned between the bevel arms; and the handle including a rectangular bore and an elongated aperture extending into the head and in communication with the rectangular bore, a switch being coupled within the bore, the switch having a bar extending into the head, the bar having a forward end including a rack with a plurality of teeth, the rack meshing with the gear teeth of the half pinion.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
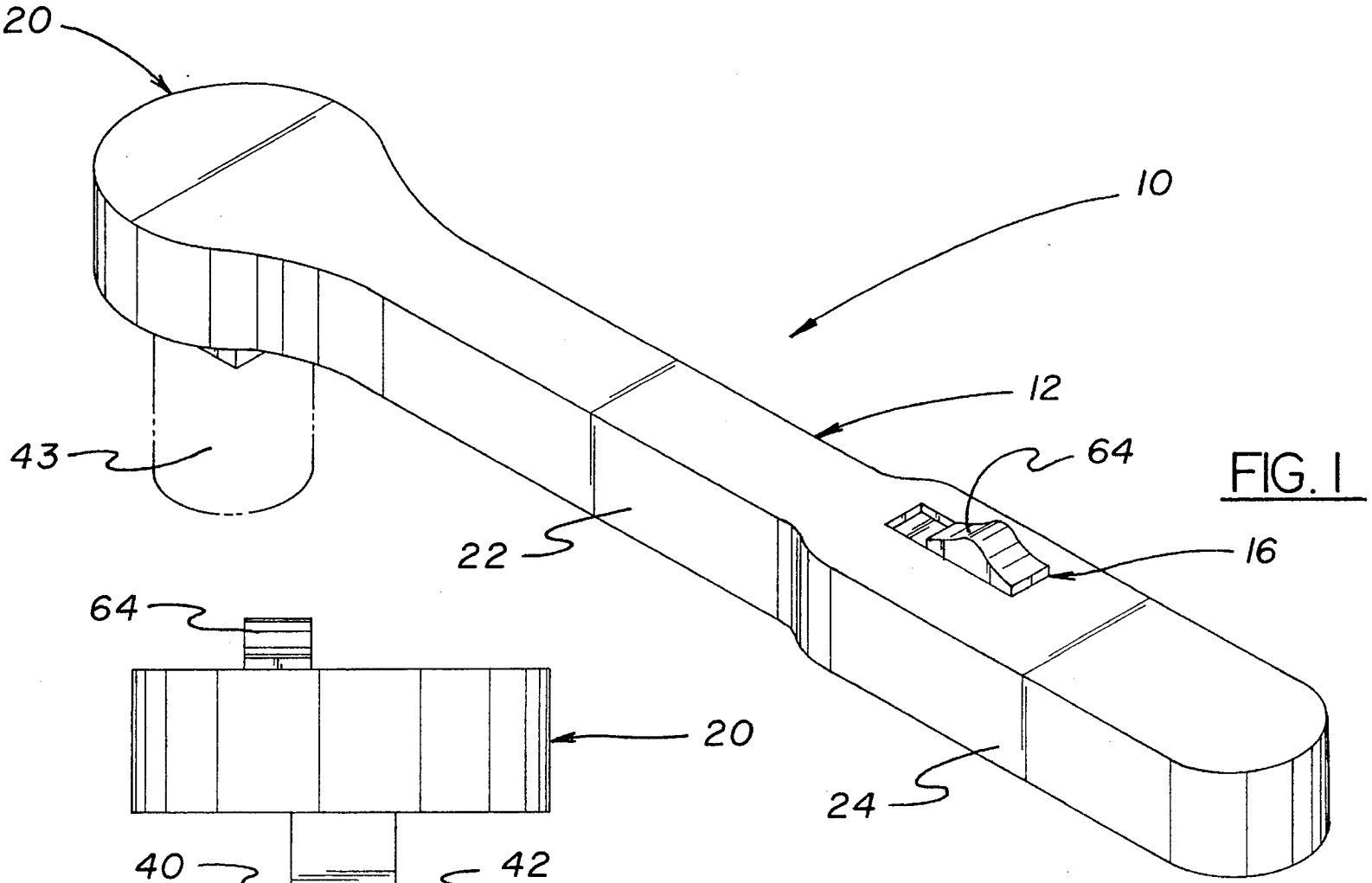
FIG. 1 is a perspective view of the preferred embodiment of the ratchet wrench with thumb activated direction control switch constructed in accordance with the principles of the present invention.

With reference now to the drawings, and in particular to FIG. 1 thereof, the preferred embodiment of the new and improved ratchet wrench with thumb activated direction control switch embodying the principles and concepts of the present invention and generally designated by the reference numeral 10 will be described.

The present invention, the ratchet wrench with thumb activated direction control switch 10 is comprised of a plurality of components. Such components in their broadest context include a shaft 12, a ratchet assembly 14 and a switch 16. Such components are individually configured and correlated with respect to each other so as to attain the desired objective.

Figure 2:
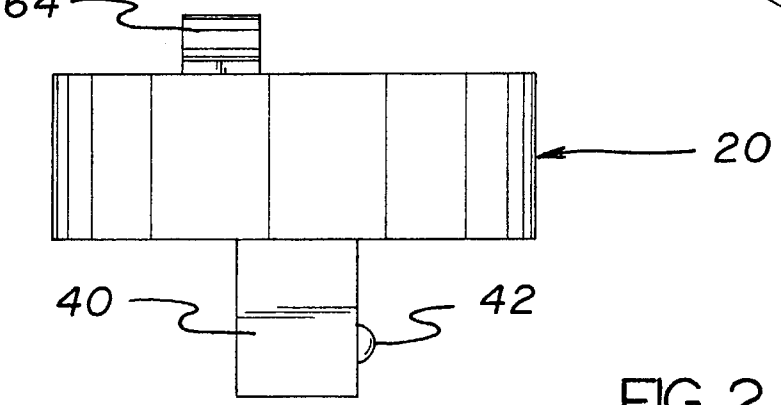
FIG. 2 is a front elevational view of the apparatus shown in FIG. 1.
Figure 3:
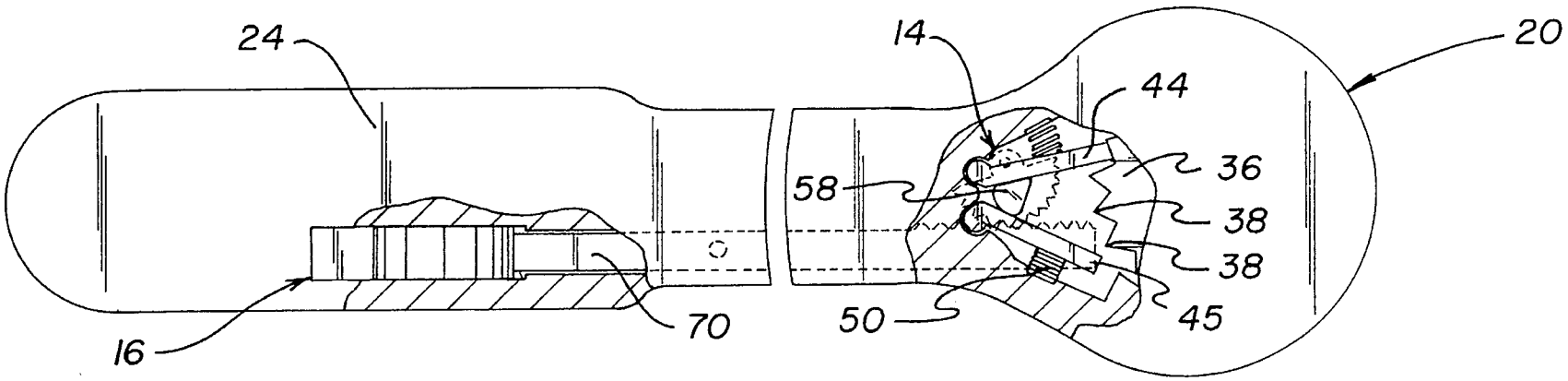
FIG. 3 is a partially broken away top perspective view illustrating the rachet assembly and switch bar of the apparatus.

More specifically, the shaft 12 is formed in an elongated configuration with a generally circular shaped head 20, a generally oval shaped handle 24 and a generally rectangular central region 22 therebetween. In the preferred embodiment the apparatus is fabricated of metal. The planar oval shape of the handle provides a secure gripping surface for the user. Note FIGS. 1, 2 and 3.

Figure 4:
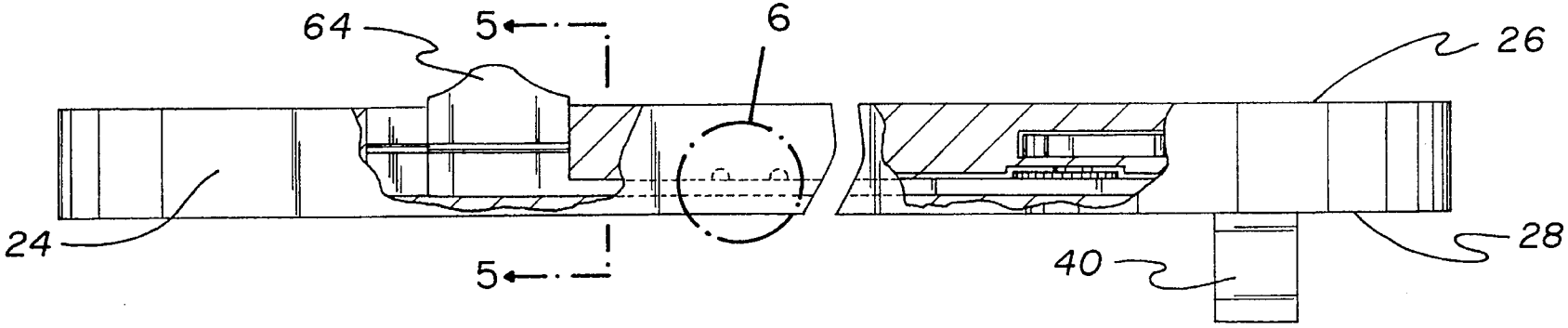
FIG. 4 is a partially broken away side perspective view illustrating the rachet assembly and switch bar of the apparatus.
Figure 7:
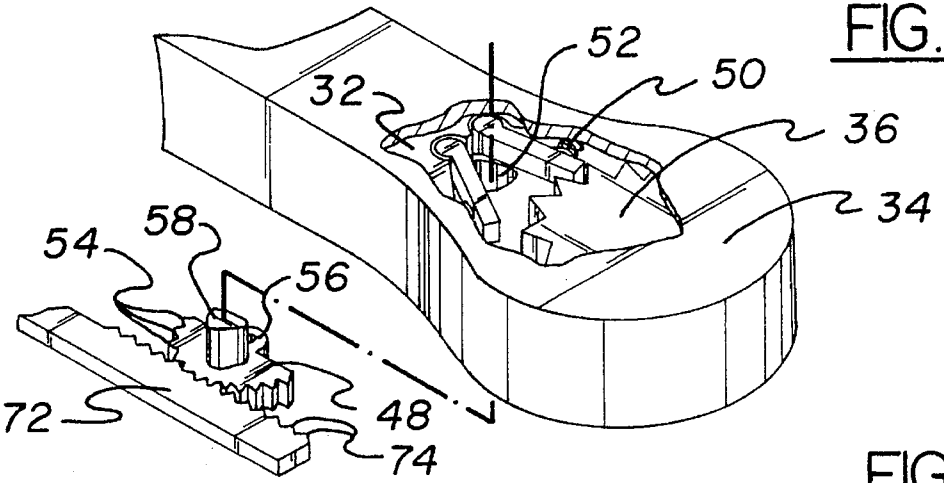
FIG. 7 is a separated perspective view of the ratchet assembly illustrating the position of the various components with respect to each other.

The head has an upper surface 26, a lower surface 28 and a central wall 30 therebetween. The head has an essentially hollow interior with an upper portion, a lower portion, an inboard section 32 and an outboard section 34. The central wall divides the head into upper and lower portions. The upper portion of the outboard section includes a large circular gear 36 rotatably mounted within it. The circular gear has a periphery including a plurality of gear teeth 38. A socket engagement block 40 is coupled to the circular gear through the central wall and lower surface of the head. The block is formed in a generally rectangular configuration with a spring biased ball 42 extending within it. The block is couplable to conventional ratchet sockets 43 as shown in FIG. 1. Note also FIGS. 3, 4 and 7.

A ratchet assembly 14 includes first 44 and second 45 bevel arms and a half pinion 48. Each bevel arm has an inner end pivotally coupled to the upper portion of the inboard section of the head. The bevel arms are angled outwardly from the pivot point to the outboard end of the head. Each bevel arm has an outer surface which includes a biasing spring 50 coupled to the inboard section of the head. The biasing springs urge the arms toward each other. When unhindered by the biasing member of the half pinion, a bevel arm becomes wedged between two teeth of the circular gear thereby securing the gear and permitting tightening or loosening of a ratchet socket coupled to the block 40. Note FIGS. 3, 4 and 7.

An aperture 52 extends through the central wall 30 between the bevel arms. The half pinion is formed in a generally semicircular configuration with a rounded perimeter which includes a plurality of gear teeth 54. The half pinion has a linear edge which includes a rounded projection 56 and an upper surface which includes an upstanding biasing member 58. The biasing member is formed in a generally triangular configuration with rounded edges. The biasing member is positionable through the aperture in the central wall and pivotable within it. The rounded projection is pivotally coupled to the central wall in the lower portion of the head thereby allowing pivotal movement of the half pinion in the lower portion. Note FIGS. 2 and 7.

Figure 6:
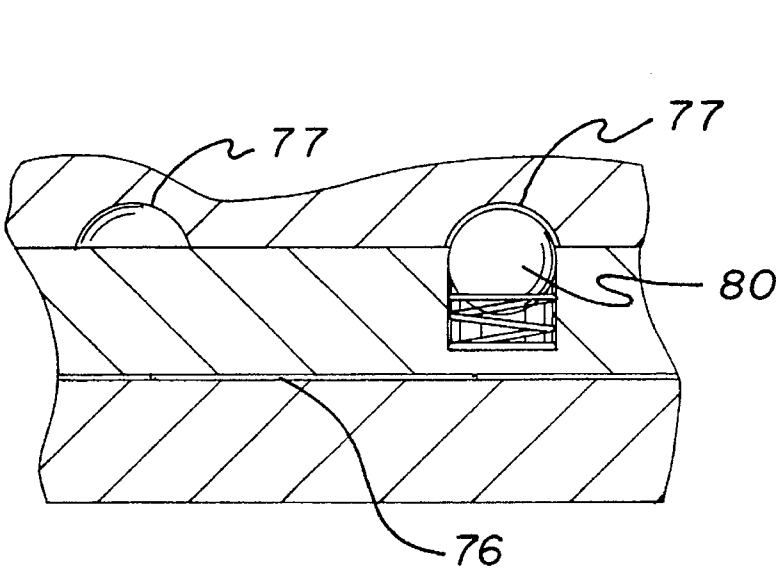
FIG. 6 is an isolated perspective view of the switch rod, indents and spring biased ball of the apparatus.

Pivotal movement of the biasing member occurs when the switch is moved. When the switch is slid to the forward position the teeth of the rack engage the teeth of the half pinion thereby forcing the rounded portion of the biasing member against the second bevel arm. This action permits the first bevel arm to become wedged within the teeth of the circular gear and allows clockwise tightening of bolts. Likewise, slidable movement of the switch into a downward position allows counter clockwise loosening of bolts. Note FIGS. 3 and 6.

Figure 5:
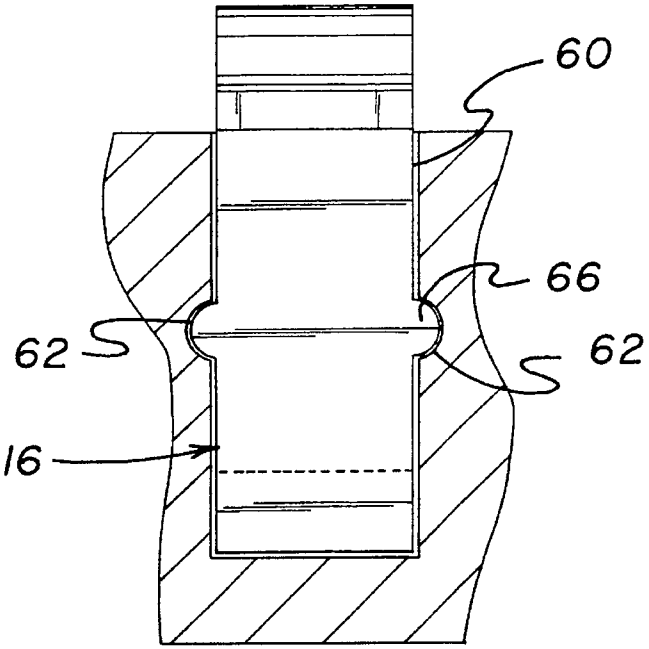
FIG. 5 is an isolated perspective view of the switch of the apparatus.

The upper surface of the handle includes a rectangular bore 60 extending through it. The bore has two sidewalls each including an elongated semicylindrical recess 62. The handle 24 and central section 22 include an elongated aperture extending through them. The elongated aperture 76 is in communication with the rectangular bore. The aperture of the central section includes two spaced semispherical indents 77. The indents are adapted to receive the spring biased balls of the switch. Note FIGS. 5 and 6.

A switch 16 is formed in a generally rectangular configuration with a raised upper surface 64. The switch has a shorter length than the bore. The switch has two sidewalls each including elongated semicylindrical projections 66. The semicylindrical projections 66 are adapted to be slidably coupled within the recesses of the bore. The upper surface of the switch extends outside the bore. The raised upper surface of the switch permits easy access by a user's thumb. This feature is very convenient to users working in confined areas. It allows them to change the turning direction of the apparatus without extricating their hands from the work space. The thumb switch is also ideal for users with reduced finger and hand dexterity. Note FIGS. 1, 3 and 4.

The switch has a lower surface which includes a planar rectangular shaped bar 70 extending from it. The bar has a forward end which includes a rack 72 with a plurality of teeth 74. The bar is positioned through the elongated aperture 76 in the handle and central sections. The rack 72 of the bar is positioned within the lower portion of the inboard section of the head with the teeth 74 of the rack meshing with the gear teeth 54 of the half pinion. The rack and pinion configuration provides an easy and efficient method of changing the turning direction of the apparatus. Note FIG. 7.

The bar includes a spring biased ball 80 extending from it and adapted to be positioned in a semispherical indent 77 in the elongated aperture. A user slides the switch into a forward position to pivot the upstanding member of the half pinion against the first bevel arm 44 thereby permitting tightening in a clockwise direction. A user slides the switch into a rearward position to pivot the upstanding member of the half pinion against the second bevel arm 45 thereby permitting loosening in a counter clockwise direction. Note FIGS. 3 and 7.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved ratchet wrench with thumb activated direction control switch comprising, in combination:

a shaft formed in an elongated configuration with a generally circular shaped head, a generally oval shaped handle and a generally rectangular central region therebetween;

the head having an upper surface, a lower surface and a central wall therebetween, the head having an essentially hollow interior with an upper portion, a lower portion, an inboard section and an outboard section, the upper portion of the outboard section including a large circular gear rotatably mounted therein, the circular gear having a periphery including a plurality of gear teeth, a socket engagement block being coupled to the circular gear through the central wall and lower surface of the head, the block being formed in a generally rectangular configuration with a spring biased ball extending therein;

a ratchet assembly including first and second bevel arms and a half pinion, each bevel arm having an inner end pivotally coupled to the upper portion of the inboard section of the head, the bevel arms being angled outwardly with respect to each other, each bevel arm having an outer surface including a biasing spring coupled to the inboard section of the head, the biasing springs urging the arms toward each other, an aperture extending through the central wall between the bevel arms, the half pinion being formed in a generally semicircular configuration with a rounded perimeter including a plurality of gear teeth, the half pinion having a linear edge including a rounded projection and an upper surface including an upstanding biasing member, the biasing member being formed in a generally triangular configuration with rounded edges, the biasing member being positionable through the aperture in the central wall and pivotable therein, the rounded projection being pivotally coupled to the central wall in the lower portion of the head thereby allowing pivotal movement of the half pinion in the lower portion;

the upper surface of the handle including a rectangular bore extending therethrough, the bore having two sidewalls each including an elongated semicylindrical recess, the handle and central section including an elongated aperture extending therethrough, the elongated aperture being in communication with the rectangular bore, the aperture of the central section including two spaced semispherical indents; and a switch formed in a generally rectangular configuration with a raised upper surface, the switch having a shorter length than the bore, the switch having two sidewalls each including elongated semicylindrical projections adapted to be slidably coupled within the recesses of the bore, the upper surface of the switch extending outside the bore, the switch having a lower surface including a planar rectangular shaped bar extending therefrom, the bar having a forward end including a rack with a plurality of teeth, the bar being positioned through the elongated aperture in the handle and central sections, the rack of the bar being positioned within the lower portion of the inboard section of the head with the teeth of the rack meshing with the gear teeth of the half pinion, the bar including a spring biased ball extending therefrom and adapted to be slidably positioned in a semispherical indent within the aperture, a user sliding the switch into a forward position to pivot the upstanding member of the half pinion against the first bevel arm thereby permitting tightening of a bolt in a clockwise direction, a user sliding the switch into a rearward position to pivot the upstanding member of the half pinion against the second bevel arm thereby permitting loosening of a bolt in a counter clockwise direction.

2. A ratchet wrench with thumb activated direction control switch comprising:

a shaft including a head with an essentially hollow interior and a handle, a circular gear being rotatably mounted within the head, a socket engagement block being coupled to the circular gear through the head, a ratchet assembly including two bevel arms pivotally coupled within the head, a half pinion being formed in a semicircular configuration with gear teeth and an upstanding biasing member, the half pinion being pivotally coupled within the head with the biasing member positioned between the bevel arms; and the handle including a rectangular bore and an elongated aperture extending into the head and in communication with the rectangular bore, a switch being coupled within the bore, the switch having a bar extending into the head, the bar having a forward end including a rack with a plurality of teeth, the rack meshing with the gear teeth of the half pinion.

3. The ratchet wrench with thumb activated direction control switch as set forth in claim 2 wherein the block is formed in a generally rectangular configuration with a spring biased ball extending therein.

4. The ratchet wrench with thumb activated direction control switch as set forth in claim 2 wherein the aperture of the central section includes two spaced semispherical indents and the switch is formed in a generally rectangular configuration with a raised upper surface, the switch having a shorter length than the bore, the switch having two sidewalls each including elongated semicylindrical projections adapted to be slidably coupled within the recesses of the bore, the upper surface of the switch extending outside the bore.

* * * * *